US006802272B2

(12) United States Patent
Ebata et al.

(10) Patent No.: US 6,802,272 B2
(45) Date of Patent: Oct. 12, 2004

(54) EMBROIDERY STITCHING SEWING MACHINE

(75) Inventors: Yoshikazu Ebata, Tokyo (JP); Koji Maeda, Tokyo (JP); Takeshi Nakamura, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 10/662,501

(22) Filed: Sep. 15, 2003

(65) Prior Publication Data

US 2004/0060493 A1 Apr. 1, 2004

(30) Foreign Application Priority Data

Sep. 30, 2002 (JP) ..... 2002-287075

(51) Int. Cl.[7] ..... D05C 5/02; D05C 9/06

(52) U.S. Cl. ..... 112/102.5; 112/470.18

(58) Field of Search ..... 112/102.5, 103, 112/470.06, 470.18, 470.14, 475.18, 475.19

(56) References Cited

U.S. PATENT DOCUMENTS 5,040,476 A * 8/1991 Takenoya et al. ..... 112/102.5

6,019,052 A * 2/2000 Stucki et al. ..... 112/102.5

* cited by examiner

*Primary Examiner*—Peter Nerbun
(74) *Attorney, Agent, or Firm*—Nields & Lemack

(57) ABSTRACT

An embroidery stitching sewing machine is disclosed, the sewing machine substantially comprising pattern selecting means for optionally selecting a desired embroidery pattern to be stitched from a plurality of different patterns memorized, an X-direction moving mechanism 4 which is accommodated in the machine housing and is operated to move in X-direction between a position adjacent the standard of sewing machine and a position spaced from the position adjacent the standard, a Y-direction drive attachment A holding an embroidering frame 10 on which a work to be stitched is set, the Y-direction drive attachment A being optionally selected from a plurality of Y-direction drive attachments 3, each of which is provided with a different type of Y-direction moving mechanism and is detachably mounted to the output potion 5 of X-direction moving mechanism 4, wherein the X-direction moving mechanism 4 and the selected Y-direction drive attachment A of Y-direction drive attachment 3 are operated in synchronism with the vertical movement of the machine needle under the control of data to form stitches in the stitching area determined by the X-direction moving mechanism 4 and the selected Y-direction drive attachment A.

22 Claims, 12 Drawing Sheets

EMBROIDERY STITCHING SEWING MACHINE

BACKGROUND OF THE INVENTION

1. Field of the Invention

The present invention relates to an embroidery stitching sewing machine which is capable of easily switched from the ordinary work stitching operation to the work embroidering operation which may be carried out in variously enlarged embroidering areas, and is further compact for putting back after stitching operation.

2. Related Art

So far, there are two types of embroidery stitching sewing machines which are operated to move an embroidering frame in X- and Y-directions in synchronism with the vertical reciprocating movements of needle to form embroidery stitches at a work held by the embroidering frame. One is of the type having an embroidering mechanism normally accommodated in the machine housing of sewing machine, and the other is of the type having an embroidering mechanism provided in an attachment which is detachably connected to the machine housing of sewing machine.

According to the embroidery stitching sewing machine having the embroidering mechanism normally accommodated in the machine housing of sewing machine, the embroidery stitching operation may be carried out with an embroidering frame being attached to the embroidering mechanism accommodated in the machine housing and with the sewing machine being switched from the ordinary stitching mode to the embroidery stitching mode to make the embroidering mechanism effective. According to this type of sewing machine, it is not required to provide a space for housing a device for detachably connect the embroidering mechanism to the machine housing. Further, in case the embroidering mechanism is accommodated within a machine base provided beneath the machine bed, the machine bed is used as a flat surface for the ordinary stitching operation only with the embroidering frame taken away. Further, in case a free arm is provided instead of the machine bed, the sleeves and cuffs of cloths may be stitched.

However according to this type of sewing machine, since the embroidering mechanism is accommodated in the machine housing, the area in which the embroidery stitches may be formed depends upon the size of machine bed. Therefore, in order to enlarge the area where the embroidery stitches may be formed, it is required to enlarge the machine housing. This is, however, practically difficult.

On the other hand, according to the sewing machine having the embroidering mechanism detachably connected thereto, the area where the embroidery stitches may be formed depends upon the size of the attachment in which the embroidering mechanism is accommodated. Therefore, the embroidering area may be enlarged by enlargement of the embroidering attachment. However, according to this type of sewing machine, the embroidering mechanism is placed on the machine bed. Therefore, in order to carry out the ordinary stitching operation on the machine bed, it is required to remove the embroidering attachment from the machine housing. Thus, in case the sewing machine is converted from the ordinary stitching mode to the embroidery stitching mode or vice versa, the big embroidering attachment must be connected to or disconnected from the machine housing. Such a converting work is actually elaborative. Moreover, in case of the sewing machine of free arm type, the embroidering attachment is connected adjacent the free arm. It is, therefore, impossible to use the free arm for embroidering the cylindrical work.

Further, since the embroidering attachment accommodates therein an X-direction drive mechanism and a Y-direction drive mechanism, the attachment is required to have a considerably large space which is square corresponding to the X-direction drive distance and the Y-direction drive distance respectively. In case the Y-direction is further elongated, so bigger embroidering attachment is required.

SUMMARY OF THE INVENTION

It is, therefore, an object of the invention to provide an embroidery stitching sewing machine which may be easily converted from the ordinary stitching mode to the embroidery stitching mode and vice versa, and may well cope with different size of embroidering areas, and further may be compact for putting back after stitching operation.

The inventors have made efforts to solve the problems of prior art. Namely in consideration of the distance that is fixed in the X-direction between the machine needle and the standard of the sewing machine, it has been decided to provide a Y-direction mechanism which may be detachably connected to the machine housing to cope with an embroidering area only in the Y-direction. The embroidery stitching sewing machine of the invention comprises an embroidering frame for holding a work to be stitched and being driven in X-direction and Y-direction which is normal to said X-direction, stitch forming means for forming stitches at said work, memory means for storing therein pattern data of embroidery patterns which may be selectable, pattern selecting means operated to optionally select any of the embroidery patterns stored in said memory means. Such constituent elements may be same with those of the prior art.

The embroidery stitching sewing machine further comprises, an X-direction moving mechanism provided in a machine housing of said sewing machine and being movable in X-direction between a position adjacent a standard of said sewing machine and a position far from said position adjacent said standard, a Y-direction drive attachment for holding said embroidering frame, said attachment having a Y-direction moving mechanism provided therewith which is movable in Y-direction normal to said X-direction, and being detachably connected to said X-direction moving mechanism. Since the Y-direction drive attachment may be moved in the Y-direction, and further may be moved in the X-direction by the X-direction moving mechanism, the, the embroidering frame mounted to the Y-direction drive attachment may be moved in the X and Y directions. Control means may be provided to control the operations of the X-direction moving mechanism, Y-direction moving mechanism and the stitch forming means in accordance with the selected pattern data, thereby to form stitches at the work held by the embroidering frame. With the combination of constituent elements, the sewing machine may be converted from the ordinary stitching mode to the embroidery stitching mode and vice versa only with the Y-direction drive attachment connected to or disconnected from the machine housing.

Further, in case a plurality of Y-direction drive attachments are provided, which having Y-direction moving mechanisms respectively structured to move different distances in the Y-direction, the Y-direction drive attachments may be optionally changed to obtain an optional Y-direction moving distance for changing the size of a pattern to be embroidered.

Further, in case the machine housing is provided with a bed and a base positioned beneath the bed, the X-direction moving mechanism may be accommodated in the base.

Further, with provision of discriminating means for comparing the moving distances of said Y-direction moving mechanisms and the pattern data stored in said memory means to discriminate if the selected pattern data may form embroidery stitches by use of a Y-direction drive attachment connected to said X-direction moving mechanism, the compatibility between the Y-direction moving mechanisms and the pattern data stored in said memory means may be confirmed. Further, indicating means may be provided, which is operated in response to the affirmative discrimination of said discriminating means to indicate the pattern data of a pattern which may be stitched by use of a Y-direction drive attachment connected to said X-direction moving mechanism. Or adversely, the indicating means may indicate the Y-direction drive attachment connected to said X-direction moving mechanism instead of the pattern data of a pattern.

Further, with provision of prohibiting means which is operated in response to the negative discrimination of said discriminating means to prohibit the stitching operation by use of the Y-direction drive attachment connected to said X-direction moving mechanism, the incompatibility between the selected pattern data and the Y-direction drive attachment may be confirmed.

Further with provision of means for setting an upper limit of stitching speed corresponding to a Y-direction drive attachment connected to said X-direction moving mechanism, the selected pattern may be embroidered at a desired stitching speed in a stabilized stitching condition in accordance with the size of embroidering area.

Further, with provision of proper detecting means for detecting said Y-direction drive attachment connected to the X-direction moving mechanism, the detecting means will not detect the Y-direction drive attachment in case the Y-direction drive attachment is not connected to the X-direction moving mechanism. In order to avoid the erroneous stitching operation without using the Y-direction drive attachment, proper means may be provided for obtaining security by prohibiting the stitching operation.

Further, the X-direction moving mechanism may be so formed as an X-direction drive attachment which is detachably connected to the machine housing.

Further, the X-direction moving mechanism and the Y-direction moving mechanism may be provided in the machine housing, and additionally a Y-direction drive attachment having a second Y-direction moving mechanism provided therewith may be detachably connected to the machine housing.

Further, specific means may be provided for giving data in connection with the size of Y-direction drive attachment which is connected to an output portion of the X-direction moving mechanism so as to enable selection of embroidery stitching of the area corresponding to given data. With such data giving means being provided, the coincidence of the embroidering area and the pattern to be stitch in the embroidering area. It is preferred that the data giving means is detecting means for detecting the Y-direction drive attachment connected the output portion of the X-direction moving mechanism.

Further, specific means may be provided for indicating the size of Y-direction drive attachment to be connected to the machine housing in agreement with the embroidery pattern selected by the pattern selecting means so that the machine operator may not commit error in selection of the embroidering area and the pattern to be stitched in the embroidering area. Further, specific means may be provided, which is operated in response to the size of selected pattern to indicate the size of Y-direction drive attachment to be connected, and simultaneously to set an upper limit to the rotation speed of machine drive motor. Thus it is possible for the machine operator to do a correct embroidery stitching operation without making a mistake in selection of the embroidering area and the pattern to be stitched in the embroidering area.

Further, the Y-direction moving mechanism may be made compact with provision of a drive motor, means operated by the drive motor to move a first member, means for amplifying the movement of the first member, a second member to be driven by the movement amplifying means, wherein the second member holds the embroidering frame.

Further, the Y-direction moving mechanism may be made compact by accommodating in the Y-direction drive attachment at least the drive motor, the means operated by the drive motor to move a first member, and the means for amplifying the movement of the first member.

The means for amplifying the movement of the first member may be designated as the one disclosed in U.S. Pat. No. 6,425,115, the disclosure of which is herein incorporated by reference.

(a) is a perspective view of the sewing machine of the invention wherein an X-direction moving mechanism is accommodated in the base of sewing machine while a Y-direction drive attachment is removed from the X-direction moving mechanism.

(b) is a perspective view of the sewing machine of the invention wherein the X-direction moving mechanism is accommodated in the base of sewing machine and the Y-direction drive attachment is mounted to the X-direction moving mechanism and the embroidering frame is mounted to the Y-direction drive attachment.

FIG. 2

(a) is a side elevational view of the sewing machine of the invention shown partly in section wherein the X-direction moving mechanism is accommodated in the base of sewing machine and the Y-direction drive attachment is mounted to the X-direction moving mechanism.

(b) is a side elevational view of the sewing machine of the invention shown partly in section wherein the X-direction moving mechanism is accommodated in the base of sewing machine and the Y-direction drive attachment is removed from the X-direction moving mechanism.

Figure 3:
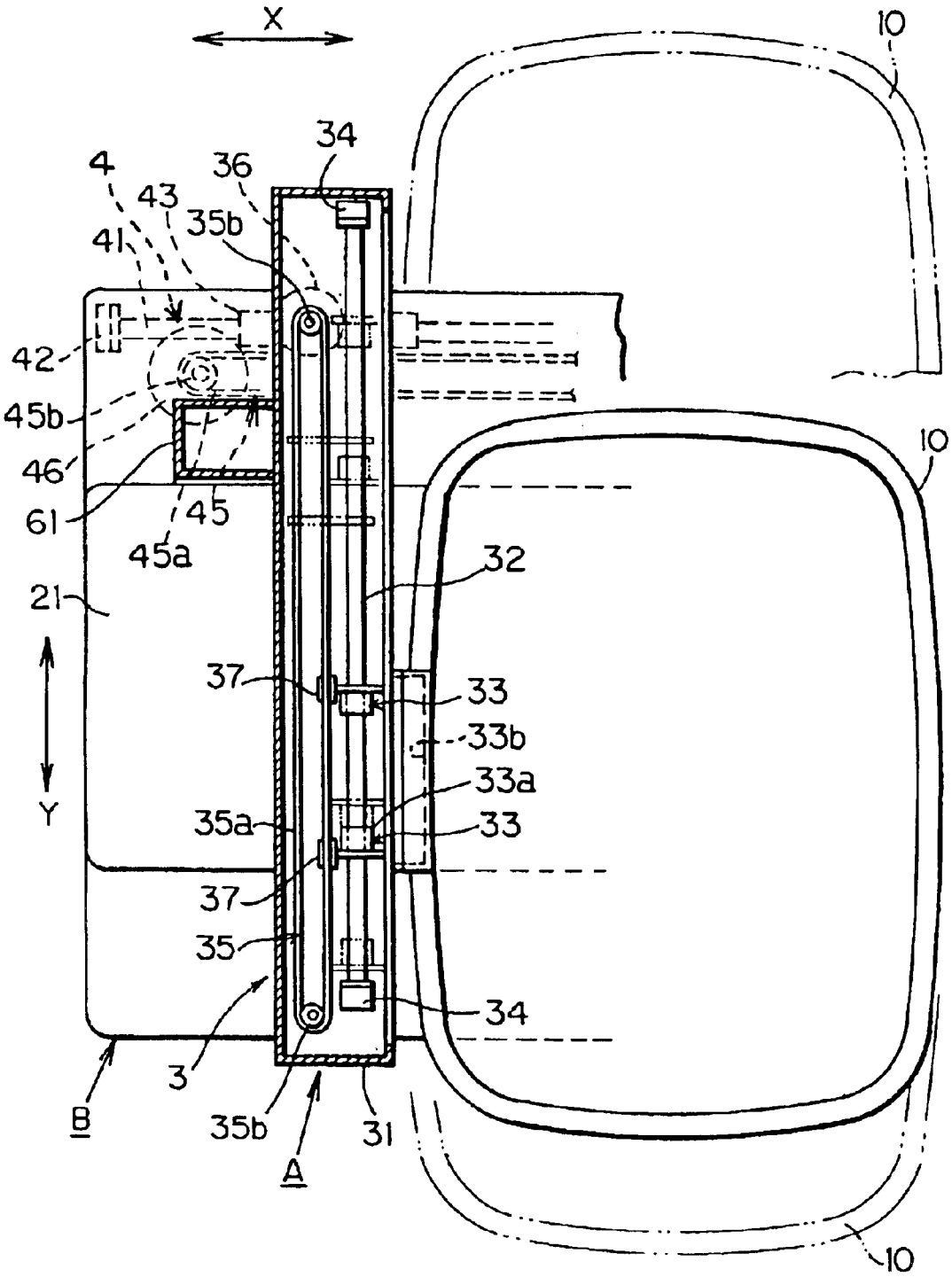

FIG. 3 is a plan elevational view of the main part of the invention having the embroidering frame mounted thereto shown partly in section.

FIG. 4

(a) is a perspective view of the main part of the invention wherein the Y-direction drive attachment and the output portion are separated.

(b) is a perspective view of the main part of the invention wherein the Y-direction drive attachment is mounted to the output portion.

Figure 5:
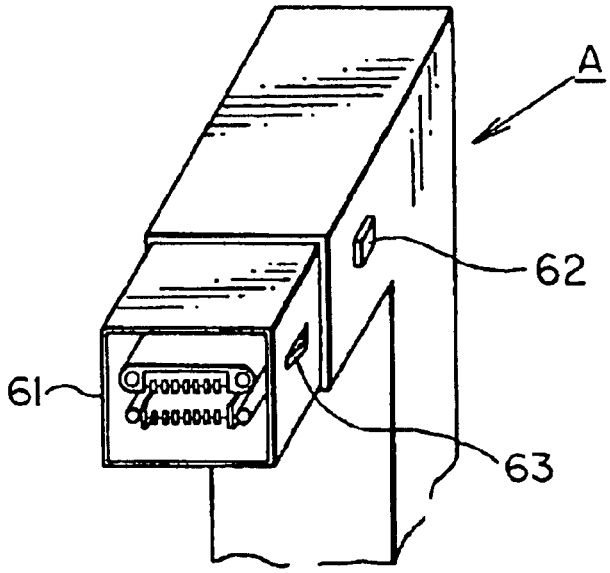

FIG. 5 is a perspective view of the Y-direction drive attachment having a connector portion.

FIG. 6

(a) is a perspective view of the Y-direction drive attachment fixed to the output portion shown partly in section.

(b) is a perspective view of the Y-direction drive attachment released from the output portion shown partly in section.

Figure 7:
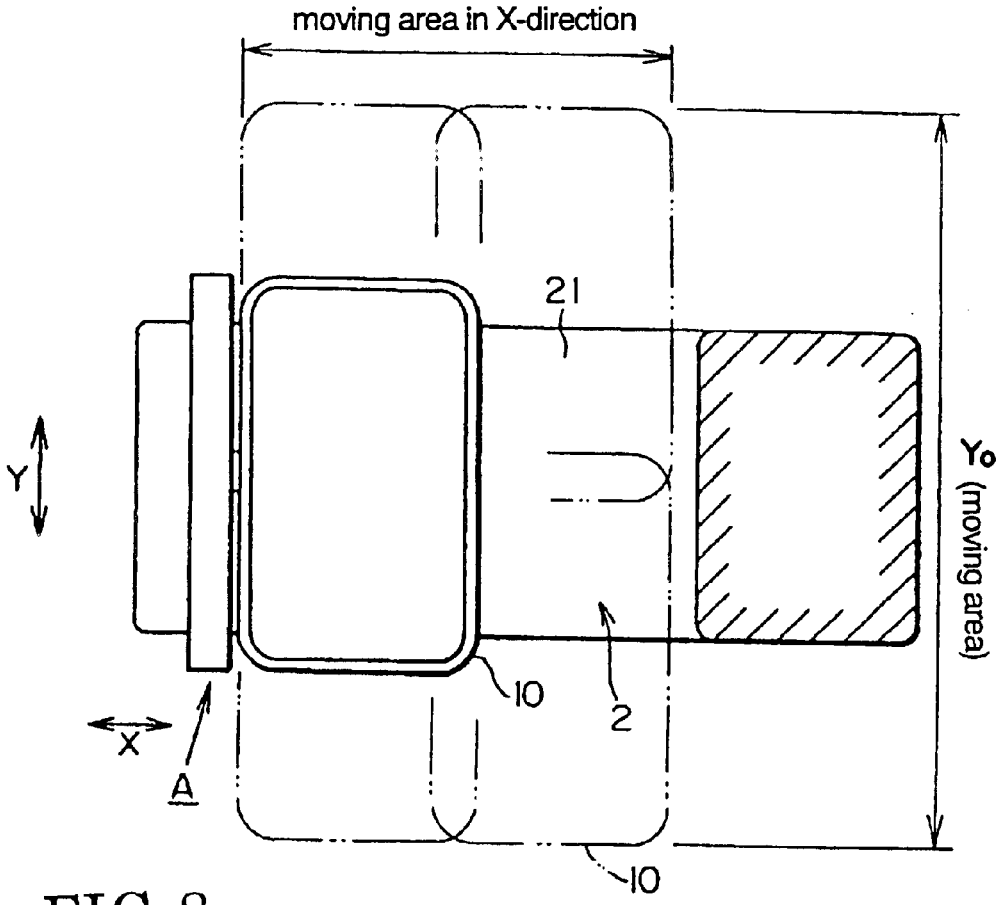

FIG. 7 is a plan elevational view of the main part of the invention shown partly in section wherein the Y-direction drive attachment of medium size is employed with the corresponding embroidering frame mounted thereto, and the area is shown where the embroidering frame may be moved.

Figure 8:
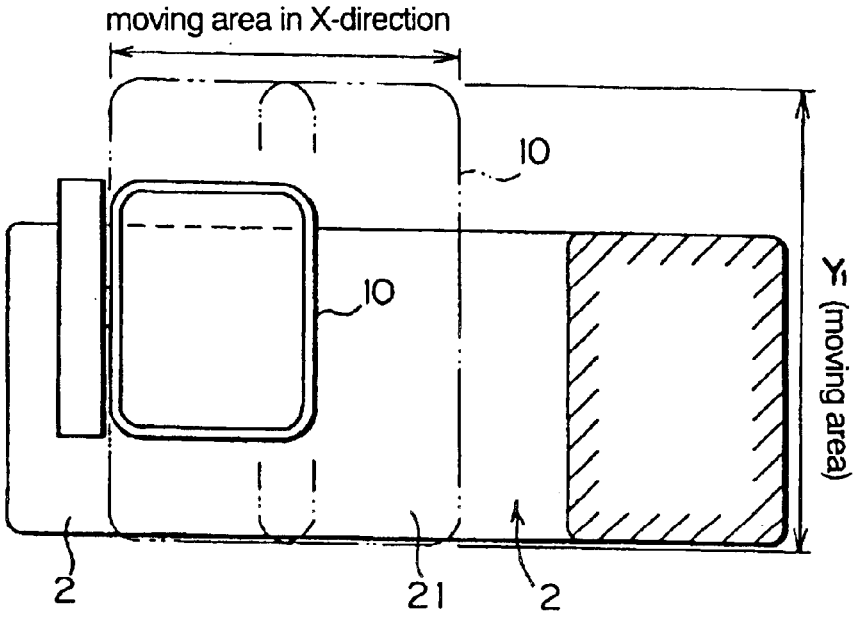

FIG. 8 is a plan elevational view of the main part of the invention shown partly in section wherein the Y-direction drive attachment of small size is employed with the corresponding embroidering frame mounted thereto, and the area is shown where the embroidering frame may be moved.

Figure 9:
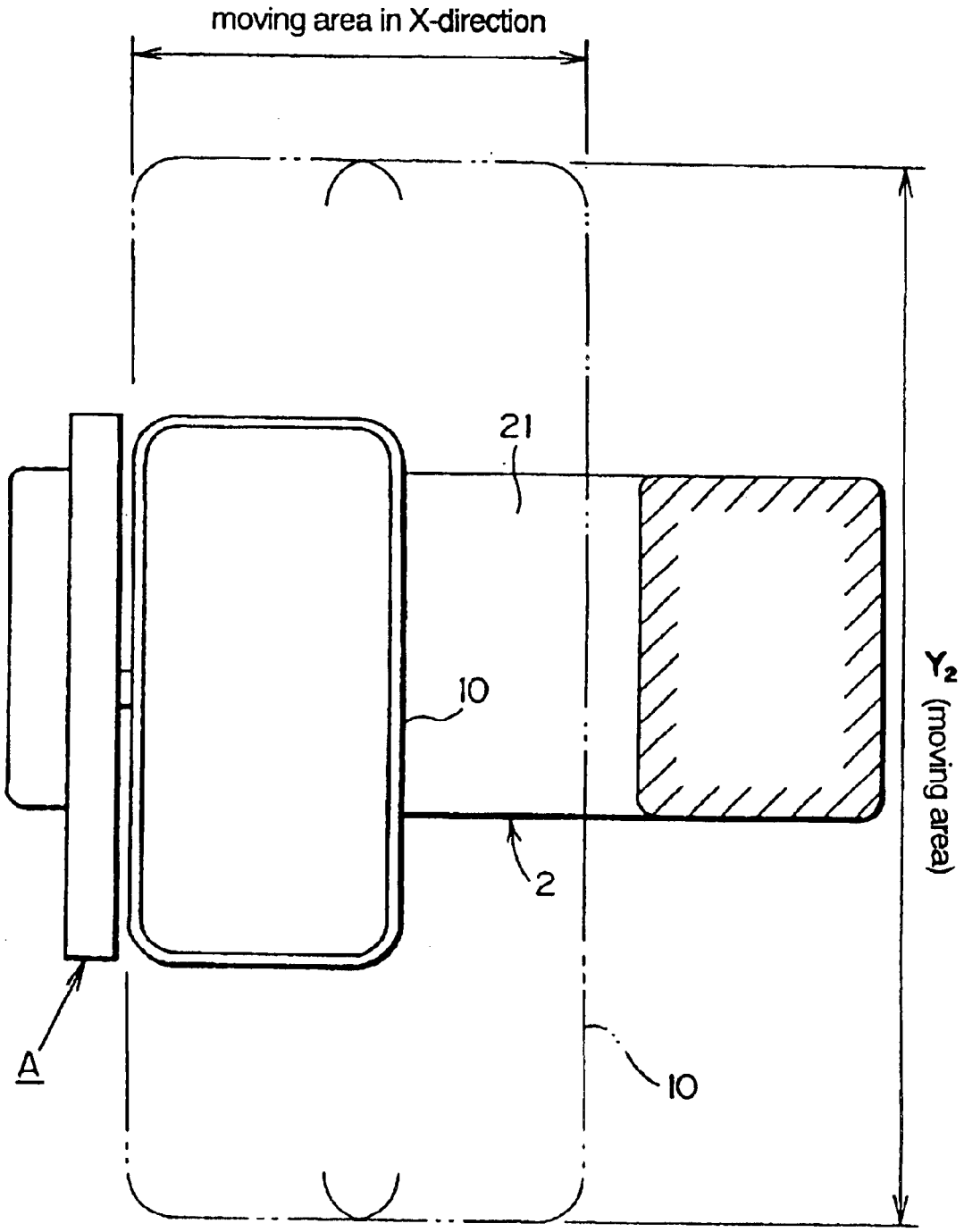

FIG. 9 is a plan elevational view of the main part of the invention shown partly in section wherein the Y-direction drive attachment of large size is employed with the corresponding embroidering frame mounted thereto, and the area is shown where the embroidering frame may be moved.

FIG. 10

(a) is a perspective view of the sewing machine of the invention wherein the X-direction moving mechanism is accommodated in the bed and the Y-direction drive attachment is removed from the X-direction moving mechanism.

(b) is a perspective view of the sewing machine of the invention wherein the X-direction moving mechanism is accommodated in the bed and the Y-direction drive attachment is mounted to the X-direction moving mechanism while the embroidering frame is mounted to the Y-direction drive attachment.

FIG. 11

(a) is a side elevational view of the sewing machine of the invention shown partly in section wherein the X-direction moving mechanism is accommodated in the bed and the Y-direction drive attachment is mounted to the X-direction moving mechanism.

(b) is a side elevational view of the sewing machine of the invention shown partly in section wherein the X-direction moving mechanism is accommodated in the bed and the Y-direction drive attachment is removed from the X-direction moving mechanism.

Figure 12:
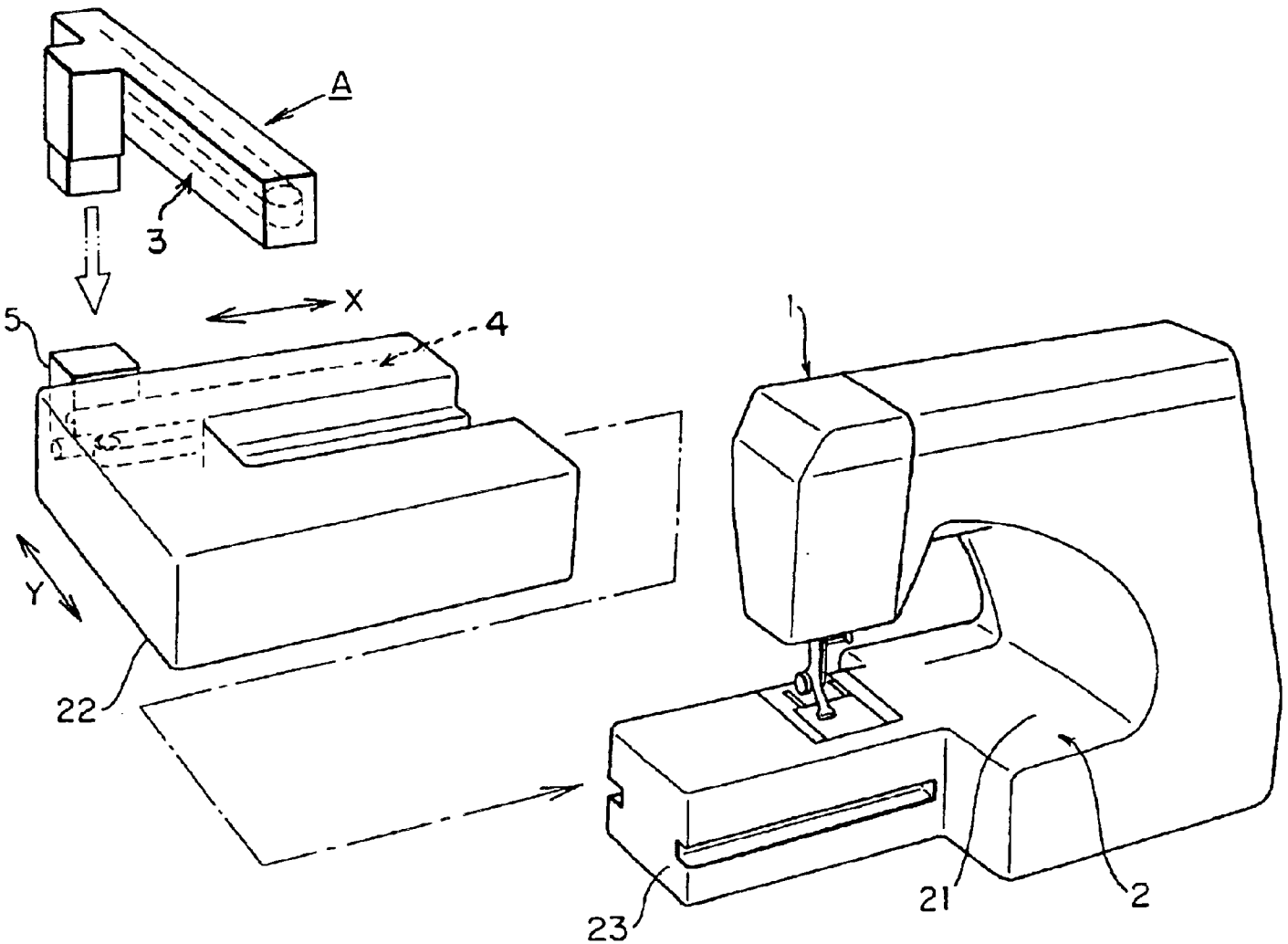

FIG. 12 is an exploded perspective view of the sewing machine of the invention provided with an X-direction attachment which is detachably mounted to the sewing machine and with the Y-direction drive attachment to be used in combination with the X-direction attachment.

Figure 13:
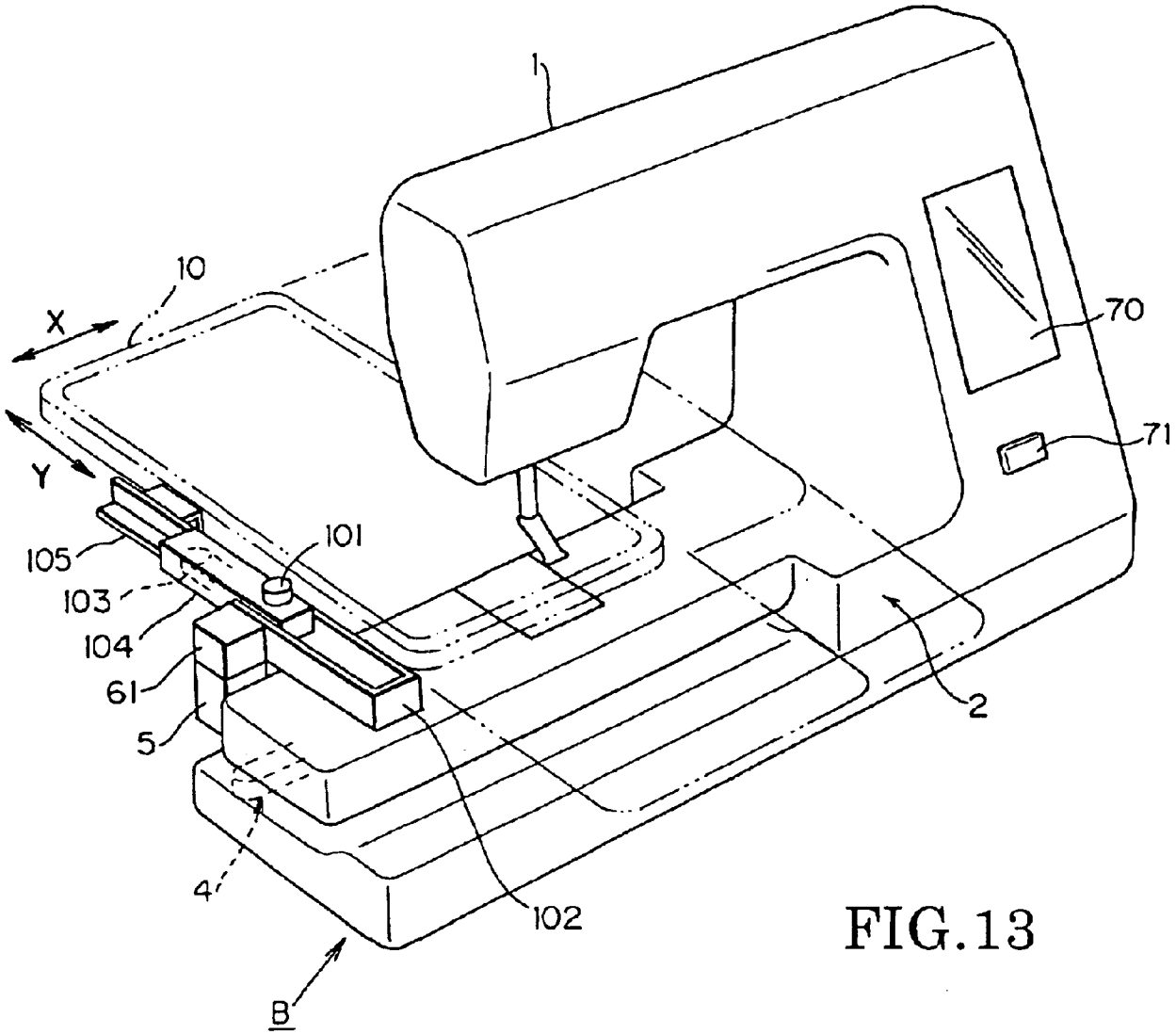

FIG. 13 is a perspective view of the sewing machine of the invention the Y-direction drive attachment provided with a means for amplifying the motion thereof.

Figure 14:
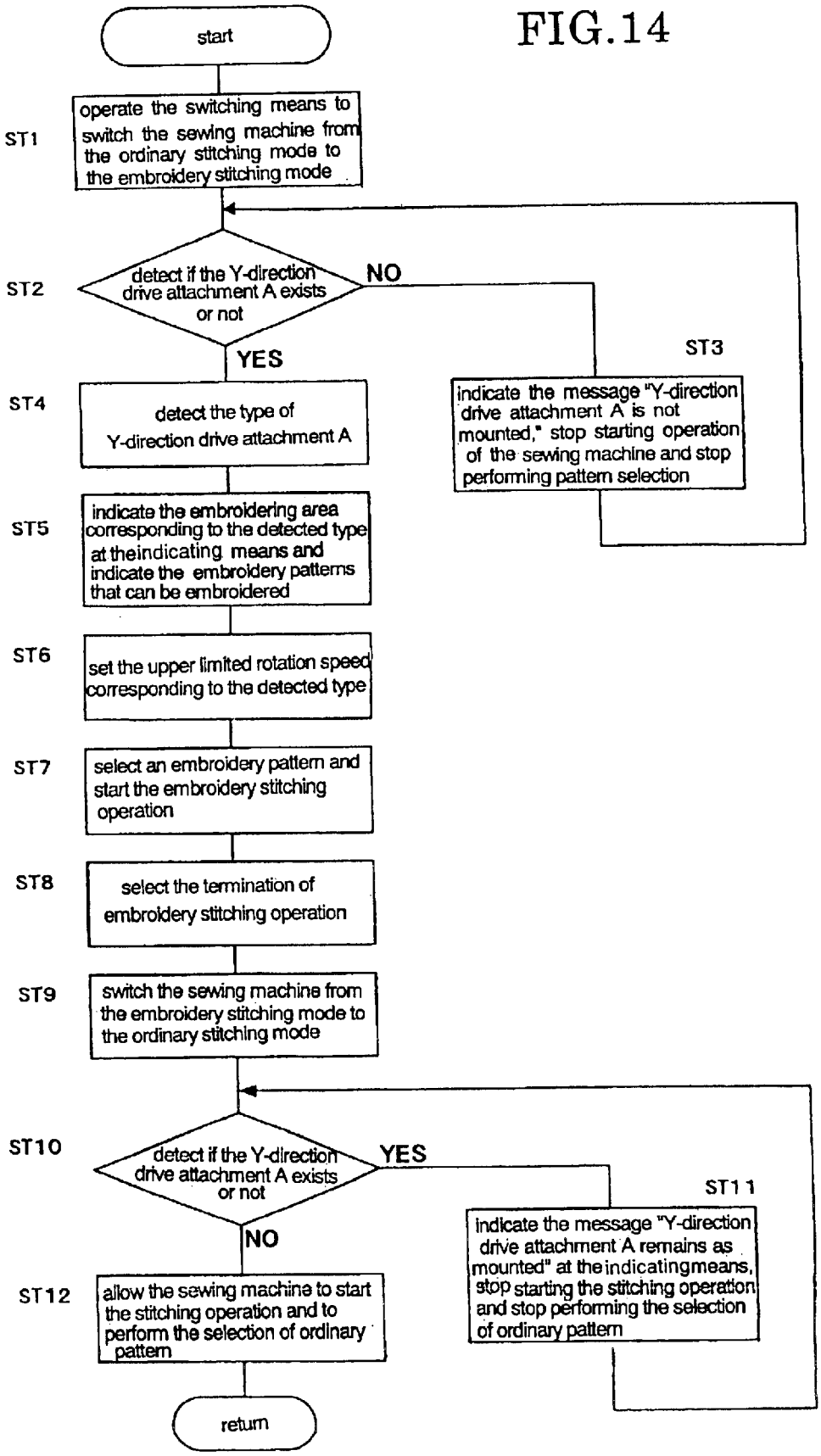

FIG. 14 is a flow chart showing the switchover between the ordinary stitching mode and the embroidery stitching mode and the process for starting the embroidery stitching operation.

DETAILED DESCRIPTION OF THE PREFERRED EMBODIMENTS

The first and second embodiments of the invention will be described in reference to the attached drawings. The first embodiment is as follows. In reference to FIG. 1, The sewing machine of the invention has a machine housing composed o a bracket 1, bed 2 and a base B. In the bracket, there are provided a drive shaft and a needle bar which is vertically reciprocated by rotation of the drive shaft. The needle bar may be laterally moved in addition to the vertical movement to form zigzag stitches in case the ordinary stitching operation is performed. However, in case of the embroidery stitching operation, the needle bar prevented from lateral movement.

Figure 1:
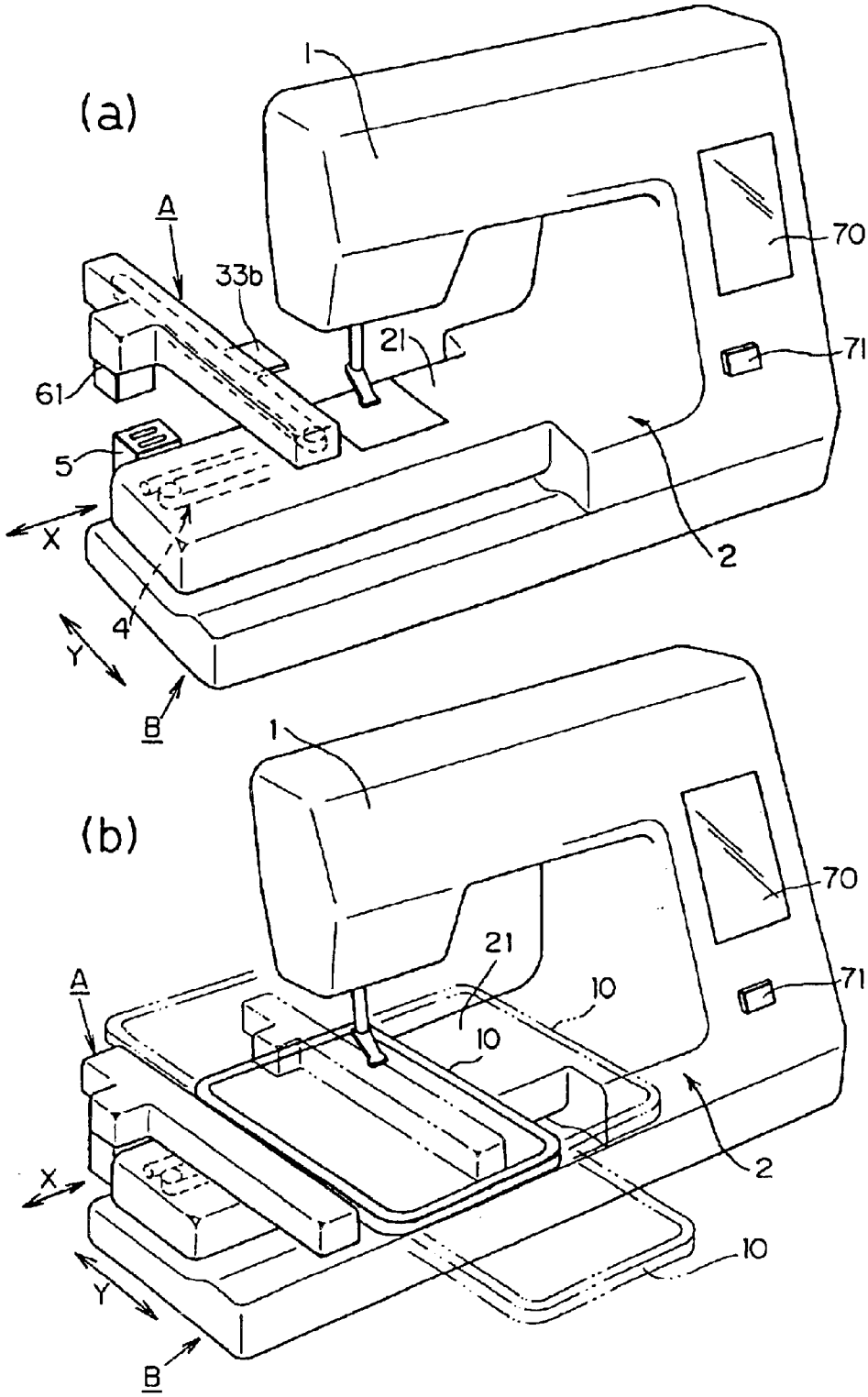
FIG. 1
Figure 2:
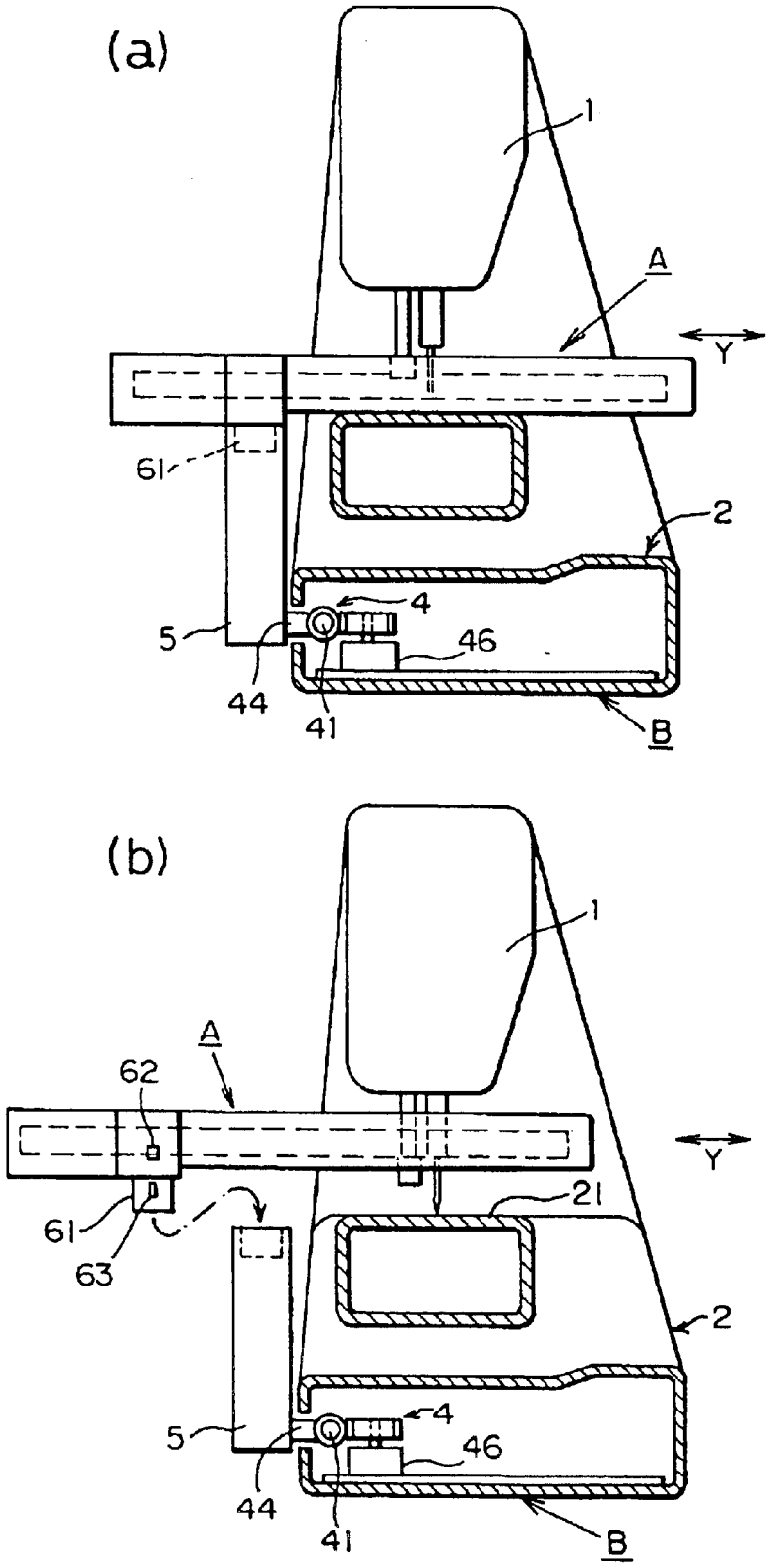

In the bed 2, there is provided a loop taking means which is operated in synchronism with the vertical movement of the needle bar to catch the thread loop formed at the needle. As shown in FIGS. 1 and 2, the bed 2 is provided with a work surface 21 having a needle plate provided thereon such that a work or cloth may be stitched on the work surface in case the ordinary stitching operation or the embroidery stitching operation is performed. It is preferred that the bed 2 is of a free arm type in case it is intended to stitch the sleeve or cylindrical work. The base B is provided beneath the bed 2 with a space provided therebetween. In the base B, there is provided an X-direction moving mechanism 4 which is operated to move an embroidering frame 10 in X-direction between a position adjacent the standard of the sewing machine and a position far from the position adjacent the standard. The X-direction moving mechanism 4 has an output portion 5 to which a Y-direction drive attachment A is mounted, which is operated to move the embroidering frame 10 in Y-direction that is normal to the X-direction. The Y-direction drive attachment A has an output portion that is a mount piece 33b to wh0.ich the embroidering frame 10 is attached so that the embroidering frame 10 may be moved on the work surface 21.

As shown in FIG. 3, the X-direction moving mechanism 4 is composed at least of an X-direction guide rail 41, an X-direction slide member 43, an X-direction drive belt portion 45 and an X-direction drive motor 46. Precisely, the X-direction guide rail 41 is arranged in the X-direction in the base B and has the opposite ends fixed to supports 42,42 respectively which are provided at the bottom of the base B. The X-direction slide member 43 is in slide engagement with the X-direction guide rail 41 such that the X-direction slide member 43 may be moved in the X-direction.

The X-direction slide member 43 has one end fixed to a connector 44 which has one end protruded from an X-direction opening formed at the base B and has the output portion 5 mounted thereto. The X-direction drive belt portion 45 is arranged in parallel with the X-direction guide rail 41 and includes an endless drive belt 45*a* wound around a pair of pulleys 45*b*, 45*b* which are spaced from each other, the endless drive belt 45*a* being driven in the axial direction of the X-direction guide rail 41. The endless drive belt 45*a* has the X-direction slide member 43 fixed to a part thereof.

One of the pulleys 45*b*, 45*b* is connected to the X-direction drive motor 46 and is driven by the motor to rotatingly move the endless belt 45*a*. The X-direction slide member 43 is, therefore, moved with the endless belt 45*a* and the output portion 5 is moved in the X-direction along the external side of the base B by way of the connector 44.

As particularly shown in FIG. 3, the Y-direction drive attachment A has a Y-direction moving mechanism 3 provided therein. The Y-direction moving mechanism 3 has a Y-direction guide rail 32 extended in the axial direction of the body 31 of the Y-direction drive attachment A. The Y-direction guide rail 32 has the opposite ends fixed to supports 34,34 respectively, and has slide members 33, 33 arranged in slide engagement therewith such that the slide members 33, 33 may be moved in the Y-direction. The slide members 33, 33 have a mount piece 33*b* formed thereat for holding the embroidering frame 10.

Further, in the Y-direction drive attachment body 31, there is provided a Y-direction drive belt portion 35 which is extended in parallel with the Y-direction guide rail 32. The Y-direction drive belt portion 35 includes an endless belt 35*a* which is extended in parallel with the Y-direction guide rail 32 and is wound around a pair of pulleys 35*b*, 35*b* so that the endless belt 35*a* may be rotatingly moved in the axial direction of the Y-direction guide rail 32. The endless belt

35*a* has the slide members 33, 33 fixed to a part thereof by way of a connector 37.

One of the pulleys 35*b*, 35*b* is connected to a Y-direction drive motor 36 and is driven by the Y-direction drive motor 36 to rotatingly move the endless belt 35*a*. The Y-direction drive motor 36 is driven by the power supplied from a power source on the side of the machine housing when the Y-direction drive attachment A is attached. The drive operation of the drive motor 36 is controlled by Y-direction data of pattern data stored on the side of the machine housing and transmitted by signal transmission means.

The movement of the endless belt 35*a* is accompanied by movement of the slide members 33, 33. Therefore, the mount piece 33*b* formed at the slide members 33, 33 is moved along the external side of the Y-direction drive attachment body 31. The Y-direction drive attachment body 31 may be detachably mounted to the output portion 5 of the X-direction moving mechanism 4. It is preferred that the power supply and signal transmission may be established simultaneously by means of a unit connection when the Y-direction drive attachment body 31 is mounted. It is, however, possible that the power supply and signal transmission may be separately established. The unit connection may be optionally selected from the various ones as are generally known, and the detail description thereof is abbreviated herein According to the embodiment of the invention, a central processing unit (CPU) is provided in the machine housing, and the CPU includes a memory for storing therein pattern data for various embroidery patterns to be stitched and pattern selecting means for optionally selecting any of the embroidery patterns stored in the memory. The pattern data stored in the memory may be the data for controlling the moving amount per stitch of the work in the X and Y directions, or may be the needle position data for producing the moving amount data per stitch of the work in the X and Y directions. From the moving amount data, the data is produced for driving the drive motor. Further, there is provided a signal transmission means for transmitting to the Y-direction drive attachment the data produced on the basis of the pattern data for driving in the Y-direction. The data produced on the basis of the pattern data for driving in the X-direction is transmitted to the drive portion of the X-direction moving mechanism.

Figure 10:
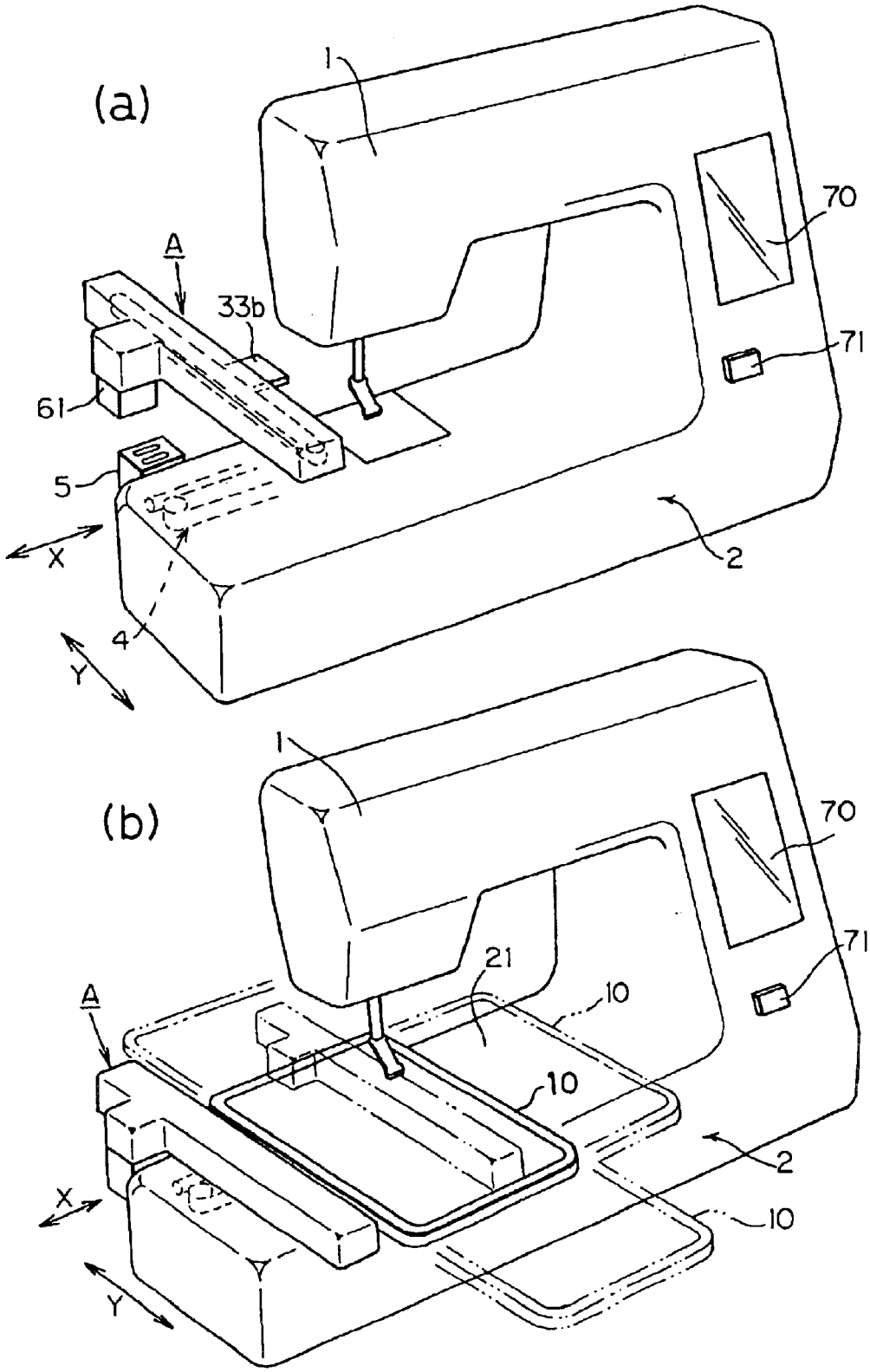
Figure 11:
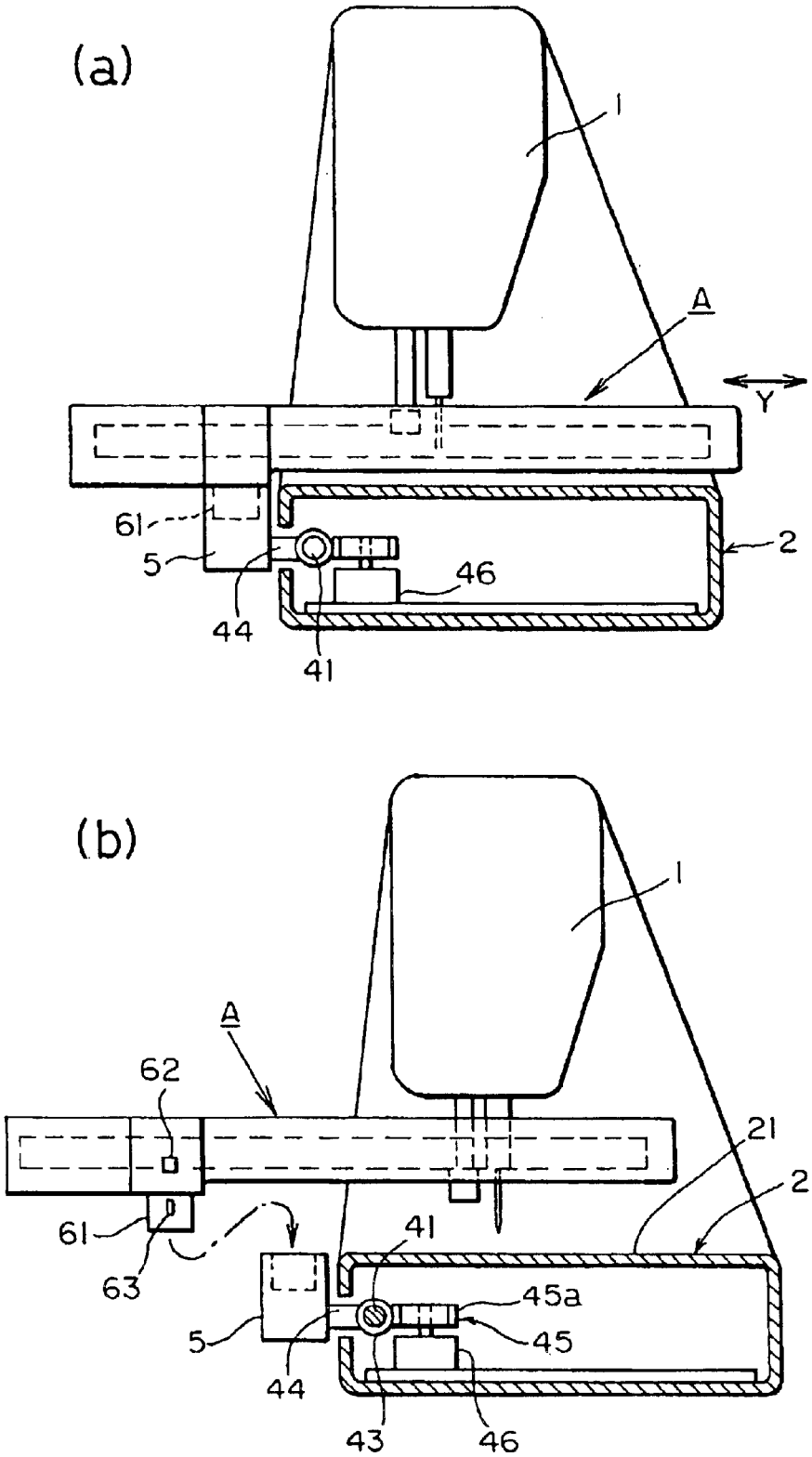

According to the embodiment of the invention, the transmission mechanism is disclosed as is use of belt and slide member. However, the transmission mechanism is not limited to this embodiment, but may be of gears, or of a lead screw as disclosed, for example, in U.S. Pat. No. 2,751,687. Further, as shown in FIGS. 1 and 2, according to the embodiment, the X-direction moving mechanism is accommodated in the bed B beneath the bed 2 in consideration of sleeve stitching in case of the ordinary stitching operation. However, the X-direction moving mechanism may be accommodated in the bed of machine housing where the loop taking mechanism is accommodated as shown in FIGS. 10 and 11.

Subsequently, a second embodiment of the invention will be described. As shown in FIG. 12, an X-direction attachment 22 in which the X-direction moving mechanism 4 is accommodated is detachably mounted to the free arm bed 2 or to the machine housing in the neighborhood of the free arm bed 2, such that the X-direction attachment 22 may be disconnected enable the machine user to perform the ordinary stitching operation by use of the free arm bed 2. In the X-direction attachment 22, the X-direction moving mechanism 4 is accommodated in the same manner as shown in the first embodiment. The detail description is, therefore, abbreviated herein.

As shown in FIG. 12, the Y-direction drive attachment A may be detachably mounted to the output portion 5 of the X-direction moving mechanism 4 of the X-direction attachment 22. The Y-direction drive attachment A is provided with the Y-direction drive mechanism 3 as is the same with the first embodiment. The detail description is, therefore, abbreviated herein.

Incidentally, it is preferable that the power supply and signal transmission to the Y-direction drive attachment A and the X-direction attachment 22 will be established by means of a connection unit, wherein a signal transmission means is made effective as is connected when the Y-direction drive attachment A is mounted to the output portion 5 of the X-direction moving mechanism 4. Further, it is preferable that the X-direction attachment 22 is connected to the signal transmission means simultaneously when the X-direction attachment 22 is mounted to the machine housing. Thus the data for X and Y will be transmitted by the signal transmission means on the basis of the X and Y direction data of patter data stored on the side of the machine housing.

The power supply and signal transmission may be made effective separately, and the connection unit may be optionally selected from the ones as generally known. The detail description is, therefore, abbreviated herein.

Figure 4:
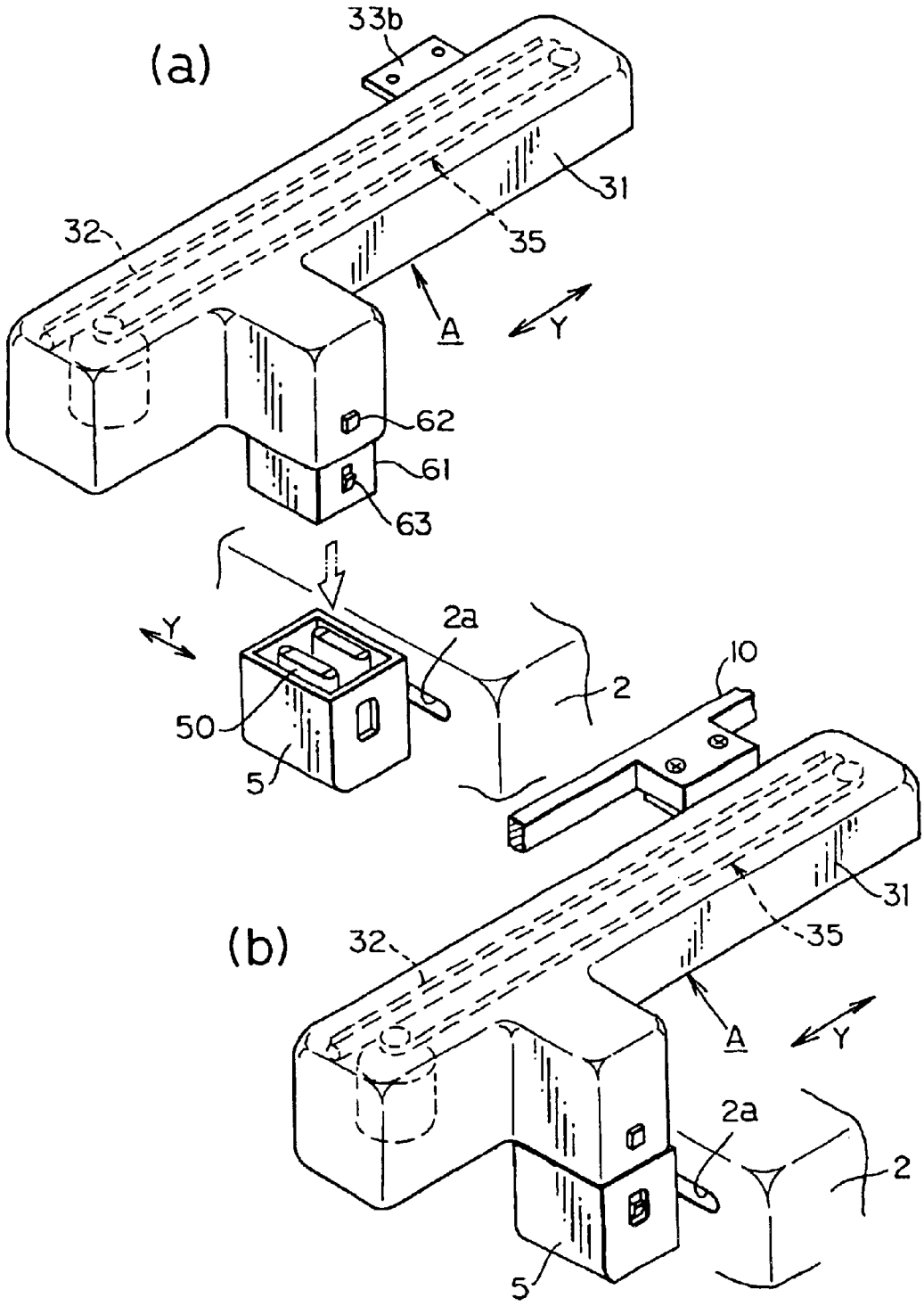

Subsequently, the change of the Y-direction drive attachment A will be described in reference to FIGS. 4 and 5, the change being common to the first and second embodiments.

The Y-direction drive attachment A is one of plural different types and may be optionally changed in accordance with the drive area which is particularly required in case an embroidery pattern is stitched in a predetermined stitching area The plural types of Y-direction drive attachments A may correspond to various embroidering areas and sizes of embroidery patterns to be stitched in embroidering areas. Therefore, a specific means may be provided to detect or identify the type of Y-direction drive attachment which is used. Namely, an attachment detector 50 may be provided at the output portion 50 to identify the Y-direction drive attachment A when this attachment is mounted to the output portion 50. The attachment detector 50 may be a photo coupler including a reflecting plate as is generally known.

Further, a security means may be provided in connection with the attachment detector 50. In the embroidery stitching mode switched from the ordinary stitching mode, the security means will prohibit the performance of embroidery stitching operation or the selection of embroidery pattern to be stitched in case the Y-direction drive attachment is not detected or identified by the attachment detector 50. Thus the use of a wrong Y-direction drive attachment or a erroneous operation may be prevented.

Figure 6:
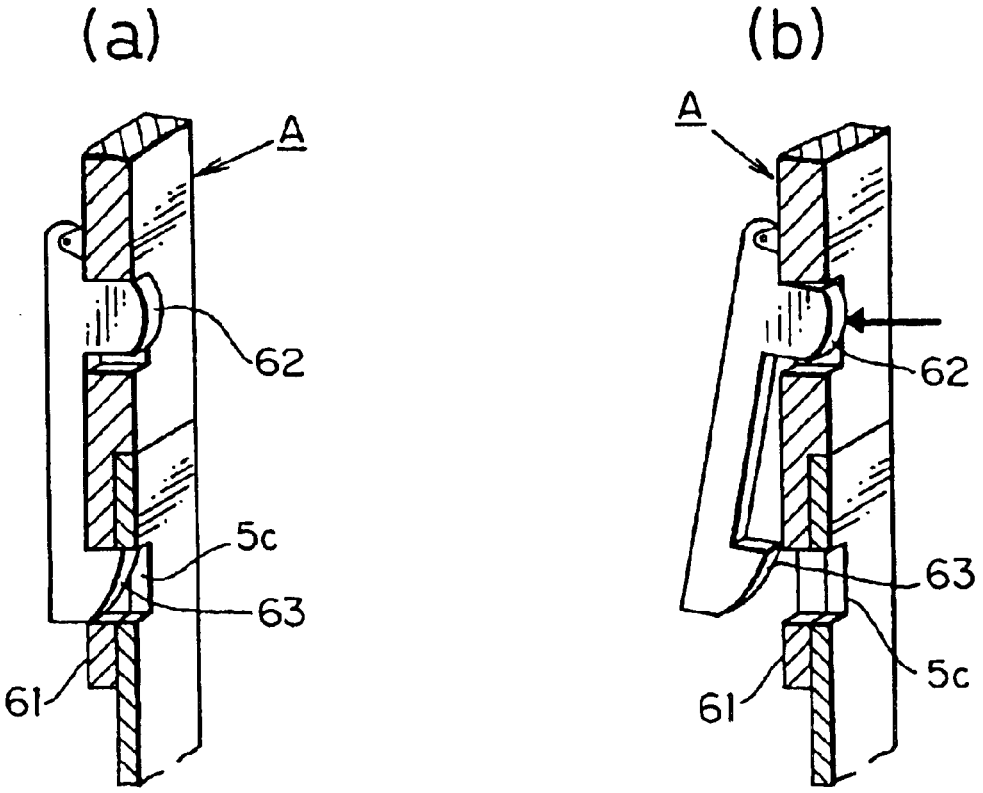

Further, in case the Y-direction drive attachment is detected at the output portion 5 in the ordinary stitching mode switched from the embroidery stitching mode, the security means will prohibit the performance of ordinary stitching operation or the selection of ordinary stitch pattern to be stitched. A release button 62 is provided so as to be operated in the ordinary stitching mode as switched from the embroidery stitching mode to release the power supply and the mechanism in connection with the Y-direction drive attachment. Namely, as shown in FIGS. 5 and 6, the release button 62 has a pawl 63 which is swingably mounted to the Y-direction drive attachment A and is normally pressed in the counter-clockwise direction by a spring by way of example. On the other hand, the output portion 5 has a cutout 5*c* formed therewith. The Y-direction drive attachment A is connected to the output portion 5 with the pawl 63 being in engagement with the cutout 5*c* when the Y-direction drive attachment A is mounted to the output portion 5. The Y-direction drive attachment A may be released from the output portion 5 by pressing the release button 62 against the spring force to swing the pawl 63 in the clockwise direction and remove the pawl 63 from the cutout 5*c*

Subsequently, according to the invention, the embroidering area or embroidery pattern may be discriminated or identified in accordance with the type of Y-direction drive attachment A which is detected or identified by the attachment detector 50. Precisely, with discrimination or identification of the type of Y-direction drive attachment A by the attachment detector 50, the embroidering area corresponding to the type of Y-direction drive attachment A may be indicated at an indicating means, or the selection of embroidery pattern corresponding to the embroidering area may be made possible. Further, the selection of embroidery pattern of size corresponding to the Y-direction drive attachment A of specific moving amount may be made possible. Thus the error in coincidence between the embroidering area and the embroidery pattern may be avoided.

Further, according to the invention, the embroidery stitching operation may be appropriately controlled with a stitching speed specific to the size of embroidering area. Namely, the machine drive motor may be controlled to have a predetermined upper limited drive speed in accordance with the type of Y-direction drive attachment A detected by the attachment detector 50, thereby to realize a stabilized embroidery stitching operation. More precisely, since a bigger embroidering frame holding so larger work to be stitched is mounted to the Y-direction drive attachment A of a larger embroidering area, it is required to set comparatively low the upper limited drive speed of machine motor in dependence on the size of Y-direction drive attachment A so as to reduce the load which is applied to the sewing machine and to the mechanism for driving the Y-direction drive attachment A.

Further, according to the invention, a specific means is provided for amplifying the motion of Y-direction moving mechanism, thereby to make the Y-direction moving mechanism mechanically compact as shown in FIG. 13. The motion amplifying mechanism is disclosed in the U.S. Pat. No. 6,435,115 of the same applicant. Therefore, the detail description of the motion amplifying mechanism is abbreviated herein. The Y-direction moving mechanism is substantially composed of a drive motor 101, a drive means 103 operated in association with the drive motor 101 to drive a first member 102 in Y-direction, a means 104 for amplifying the motion of the first member 102 by driving a second member 105 to which the embroidering frame 10 is mounted. The drive motor 101, drive means 103, motion amplifying means 104 are accommodated in the Y-direction drive attachment A, wherein the second member 105 is moved as amplified in the direction out of the Y-direction drive attachment A. Thus the Y-direction drive attachment A may be made mechanically compact in connection to the embroidering area.

Subsequently, description will be made concerning the change of stitching mode and the embroidery stitching operation of the first embodiment in reference to the flow chart as shown in FIG. 14. In step 1, a switching means provided on the front side of the sewing machine is operated to switch the sewing machine from the ordinary stitching mode to the embroidery stitching mode. In step 2, the attachment detector 50 detects if the Y-direction drive attachment A exists or not. In case the Y-direction drive attachment A is not detected, the message "Y-direction drive attachment A is not mounted" is indicated at the indicating means in Step 3. Thus the machine user is requested to mount the Y-direction drive attachment A and simultaneously the sewing machine is prevented from starting operation and from performing pattern selection. In case the attachment detector 50 detects the Y-direction drive attachment A, the detector 50 detects the type of Y-direction drive attachment A in step 4. In step 5, the embroidering area corresponding to the type of Y-direction drive attachment A is indicated at the indicating means, and simultaneously the embroidery patterns which may be stitched in the embroidering area are indicated. In step 6, the machine drive motor is set to rotate at the predetermined upper limited rotation speed corresponding to the type of Y-direction drive attachment A detected by the attachment detector 50.

In step 7, the machine user optionally selects an embroidery pattern and starts the embroidery stitching operation under the control of X-direction moving mechanism and Y-direction moving mechanism. In step 8, the machine user selects the termination of embroidery stitching operation. In step 9, the machine user switches the sewing machine from the embroidery stitching mode to the ordinary stitching mode. In step 10, the attachment detector 50 detects if the Y-direction drive attachment A exists or not. In case the Y-direction drive attachment A is detected, the message "Y-direction drive attachment A remains as mounted" is indicated at the indicating means in step 11. Thus the machine user is requested to remove the Y-direction drive attachment A and simultaneously the sewing machine is prevented from starting the stitching operation and from performing the selection of ordinary pattern. In case the release button is operated to and the Y-direction drive attachment A is removed, the attachment detector 50 detects the removal of Y-direction drive attachment A. In step 12, the sewing machine is allowed to start the stitching operation and to perform the selection of ordinary pattern.

Concerning the second embodiment, the X-direction attachment 22 is detachably mounted to the bed 2 of free arm type. The other matters including the detection of the X-direction attachment 22, allowance and prohibition of stitching operation are same with the first embodiment. Therefore the detail description is abbreviated herein.

Prior to starting the embroidery stitching operation, the machine user is firstly requested to select a Y-direction drive attachment A in consideration of the size, for example, small, medium, large of embroidery pattern to be stitched. Then the machine user is requested to mount the Y-direction drive attachment A to the output portion 5 of X-direction moving mechanism 4 as shown in FIG. 2(*a*). Then the embroidering frame 10 of medium size is mounted to the Y-direction drive attachment A as shown in FIG. 7. In this case, the embroidery stitching operation may be performed in the area $Y_0$ in the Y-direction. In case the Y-direction drive attachment A is selected corresponding to the embroidering frame 10 of small size, the embroidery stitching operation may be performed in the area $Y_1$ in the Y-direction as shown in FIG. 8, the embroidering area $Y_1$ being about half of the embroidering area $Y_0$ in FIG. 7.

In case the Y-direction drive attachment A is selected corresponding to the embroidering frame 10 of large size, the embroidery stitching operation may be performed in the area $Y_2$ in the Y-direction as shown in FIG. 9, the embroidering area $Y_2$ being about twice of the embroidering area $Y_0$ in FIG. 7. These are all realized only by changing the Y-direction drive attachment A. In case the ordinary stitching operation is performed without using the Y-direction drive attachment A, the attachment detector 50 will not detect the existence of Y-direction drive attachment A, and the output portion 5 is moved to a place where the output portion 5 is not obstacle to the ordinary stitching operation such that the working surface 21 of machine housing 2 may be used as a flat surface.

Incidentally, according to the embodiments of the invention, the attachments of Y-direction moving mechanisms of different moving areas are detected or identified by means of photo-coupler or the like so as to realize a desired embroidering stitching operation. Otherwise, it is possible to input the size or signal specific to the attachment mounted by the machine user. With this input implemented, the allowance of embroidery stitching operation may be obtained or the size of selected embroidery pattern may be compared in the same manner as in the embodiments as described above.

EFFECTS OF THE INVENTION

According to the invention, the sewing machine may perform the embroidery stitching operation by means of the X-direction moving mechanism and the Y-direction moving mechanism. More particularly, a plurality of Y-direction drive attachments are provided with different types of Y-direction moving mechanisms accommodated therein. Therefore, the Y-direction drive attachments may be selectively used to meet the desire for enlarging the embroidering area.

Further, since the Y-direction drive attachment to be arranged on the bed surface is detachably mounted, the switchover between the ordinary stitching mode and the embroidery stitching mode is very easily implemented simply by mounting and removing the Y-direction drive attachment.

In case the Y-direction drive attachment is detachably mounted to the embroidering attachment having the X-direction moving mechanism accommodated therein, and in case the X-direction moving mechanism is accommodated in the machine housing, the ordinary stitching operation is performed simply by removing the Y-direction drive attachment. Further, in case the upper surface of embroidering attachment is made to be coplanar with the upper surface of bed, the working area may be enlarged for the convenience of ordinary stitching operation.

Further, since the attachment detector is provided to detect the Y-direction drive attachment mounted to the output portion of X-direction moving mechanism, the attachment detector will not detect the Y-direction drive attachment mounted in case the attachment is not mounted, and the embroidery stitching operation is prohibited. Therefore, the security may be obtained in case of selection of the embroidery stitching mode.

Further, since the embroidery stitching operation is allowed with detection of the Y-direction drive attachment mounted to the output portion of X-direction, the divergence will not occur between the embroidering area and the embroidery pattern which are determined by the Y-direction drive attachment.

Further since the selection of embroidery stitching operation of is allowed in the embroidering area corresponding to the data given in connection with the size of Y-direction drive attachment mounted to the output portion of X-direction moving mechanism, the divergence will not occur between the embroidering area and the embroidery pattern which are determined by the Y-direction drive attachment.

Further since the instruction is given as to the size of Y-direction drive attachment to be mounted in response to the size of embroidery pattern selected by operation of pattern selecting means, the divergence will not occur between the selected pattern and the embroidering area.

Further since the upper limited drive speed of machine drive motor is set in accordance with the Y-direction drive attachment mounted to the output portion of X-direction moving mechanism and detected by the attachment detector, a stabilized embroidery stitching operation may be performed at a stitching speed which is specific to the size of embroidering area.

Further since the Y-direction moving mechanism is provided with the means for amplifying the motion thereof, the Y-direction moving mechanism may be made compact in connection to the embroidering area.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An embroidery stitching machine comprising;

an embroidering frame for holding a work to be stitched and being driven in an X-direction and a Y-direction which is normal to said X-direction, stitch forming means for forming stitches at said work, memory means for storing therein pattern data of embroidery patterns which may be selectable, pattern selecting means operated to optionally select any of the embroidery patterns stored in said memory means, an X-direction moving mechanism provided in a machine housing of said sewing machine and being movable in the X-direction between a position adjacent a standard of said sewing machine and a position far from said position adjacent said standard, a Y-direction drive attachment for holding said embroidering frame, said attachment having a Y-direction moving mechanism provided therewith which is movable in Y-direction normal to said X-direction, and being detachably connected to said X-direction moving mechanism, control means for controlling the operations of said X-direction moving mechanism, said Y-direction moving mechanism and said stitch forming means in accordance with the pattern data optionally selected by said pattern selecting means, thereby to form embroidery stitches at said work.

2. The embroidery stitching sewing machine as defined in claim 1, wherein said machine housing has a bed and a base provided therewith, said base being positioned beneath said bed, and wherein said X-direction moving means is housed within said base.

3. The embroidery stitching sewing machine as defined in claim 1, wherein a plurality of Y-direction drive attachments having Y-direction moving mechanisms respectively may be detachably connected to said X-direction moving mechanism, said Y-direction moving mechanisms being so structured as to move different distances.

4. The embroidery stitching sewing machine as defined in claim 3, further comprising discriminating means for comparing the moving distances of said Y-direction moving mechanisms and the pattern data stored in said memory means to discriminate if the selected pattern data may form embroidery stitches by use of a Y-direction drive attachment connected to said X-direction moving mechanism.

5. The embroidery stitching sewing machine as defined in claim 4, further comprising indicating means operated in response to the affirmative discrimination of said discriminating means to indicate the pattern data of a pattern which may be stitched by use of a Y-direction drive attachment connected to said X-direction moving mechanism.

6. The embroidery stitching sewing machine as defined in claim 4, further comprising indicating means operated in response to the affirmative discrimination of said discriminating means to indicate the Y-direction drive attachment connected to said X-direction moving mechanism and adapted to the corresponding pattern data.

7. The embroidery stitching sewing machine as defined in claim 4, further comprising prohibiting means operated in response to the negative discrimination of said discriminating means to prohibit the stitching operation by use of the Y-direction drive attachment connected to said X-direction moving mechanism.

8. The embroidery stitching sewing machine as defined in claim 3, further comprising means for setting an upper limit of stitching speed corresponding to a Y-direction drive attachment connected to said X-direction moving mechanism.

9. The embroidery stitching sewing machine as defined in claim 1, further comprising detecting means for detecting said Y-direction drive attachment connected to said X-direction moving mechanism.

10. The embroidery stitching sewing machine as defined in claim 9, further comprising prohibiting means for prohibiting the stitching operation by use of the Y-direction drive attachment in case said Y-direction drive attachment is not detected by said detecting means when said Y-direction drive attachment is connected to said X-direction moving mechanism.

11. The embroidery stitching sewing machine as defined in claim 1, further comprising motion amplifying means for amplifying the movement of said Y-direction moving mechanism beyond the movement of a drive source.

12. An embroidery stitching machine comprising;

an embroidering frame for holding a work to be stitched and being driven in an X-direction and a Y-direction which is normal to said X-direction, stitch forming means for forming stitches at said work, memory means for storing therein pattern data of embroidery patterns which may be selectable, pattern selecting means operated to optionally select any of the embroidery patterns stored in said memory means, an X-direction drive attachment detachably connected to a machine housing of said sewing machine and having an X-direction moving mechanism provided therein, said X-direction moving mechanism being movable in the X-direction between a position adjacent a standard of said sewing machine and a position far from said position adjacent said standard, a Y-direction drive attachment for holding said embroidering frame, said attachment having a Y-direction moving mechanism provided therewith which is movable in Y-direction normal to said X-direction, and being detachably connected to said X-direction moving mechanism, control means for controlling the operations of said X-direction moving mechanism, said Y-direction moving mechanism and said stitch forming means in accordance with the pattern data optionally selected by said pattern selecting means, thereby to form embroidery stitches at said work.

13. The embroidery stitching sewing machine as defined in claim 12, wherein a plurality of Y-direction drive attachments having Y-direction moving mechanisms respectively, said Y-direction moving mechanisms being so structured as to move different distances.

14. The embroidery stitching sewing machine as defined in claim 13, further comprising discriminating means for comparing the moving distances of said Y-direction moving mechanisms and the pattern data stored in said memory means to discriminate if the selected pattern data may form embroidery stitches by use of a Y-direction drive attachment connected to said X-direction moving mechanism.

15. The embroidery stitching sewing machine as defined in claim 14, further comprising indicating means operated in response to the affirmative discrimination of said discriminating means to indicate the pattern data of a pattern which may be stitched by use of a Y-direction drive attachment connected to said X-direction moving mechanism.

16. The embroidery stitching sewing machine as defined in claim 14, further comprising indicating means operated in response to the affirmative discrimination of said discriminating means to indicate the Y-direction drive attachment connected to said X-direction moving mechanism and adapted to the corresponding pattern data.

17. The embroidery stitching sewing machine as defined in claim 14, further comprising prohibiting means operated in response to the negative discrimination of said discriminating means to prohibit the stitching operation by use of the Y-direction drive attachment connected to said X-direction moving mechanism.

18. The embroidery stitching sewing machine as defined in claim 13, further comprising means for setting an upper limit of stitching speed corresponding to a Y-direction drive attachment connected to said X-direction moving mechanism.

19. The embroidery stitching sewing machine as defined in claim 12, further comprising detecting means for detecting said Y-direction drive attachment connected to said X-direction moving mechanism.

20. The embroidery stitching sewing machine as defined in claim 19, further comprising prohibiting means for prohibiting the stitching operation by use of the Y-direction drive attachment in case said Y-direction drive attachment is not detected by said detecting means when said Y-direction drive attachment is connected to said X-direction moving mechanism.

21. An embroidery stitching machine comprising;

an embroidering frame for holding a work to be stitched and being driven in an X-direction and a Y-direction which is normal to said X-direction, stitch forming means for forming stitches at said work, memory means for storing therein pattern data of embroidery patterns which may be selectable, pattern selecting means operated to optionally select any of the embroidery patterns stored in said memory means, an X-direction moving mechanism provided in a machine housing of said sewing machine and being movable in the X-direction between a position adjacent a standard of said sewing machine and a position far from said position adjacent said standard, a Y-direction moving mechanism provided in a machine housing of said sewing machine and being movable in Y-direction normal to said X-direction, an output portion which may be moved in said X and Y directions by said X and Y-direction moving mechanisms, a Y-direction drive attachment for holding said embroidering frame, said Y-direction drive attachment being provided with a second Y-direction moving mechanism which is movable in Y-direction normal to said X-direction, and being detachably connected to said output portion, control means operated in accordance with the pattern data selected by said pattern selecting means to control the operations of said X-direction moving mechanism, said Y-direction moving mechanism and said second Y-direction moving mechanism, thereby to form embroidery stitches at said work.

22. The embroidery stitching sewing machine as defined in claim 21, wherein a plurality of second Y-direction drive attachments having Y-direction moving mechanisms respectively, said Y-direction moving mechanisms being so structured as to move different distances.

* * * * *